United States Patent [19]

Tilley

[11] 3,991,854

[45] Nov. 16, 1976

[54] AUTOMOBILE ELECTRIC VACUUM PUMP FILTERING SYSTEM

[76] Inventor: Howard C. Tilley, 7220 N.W. Coronado, Kansas City, Mo. 64152

[22] Filed: May 9, 1974

[21] Appl. No.: 468,231

[52] U.S. Cl. ..... 184/1.5
[51] Int. Cl.[2] ..... F16M 13/02
[58] Field of Search ..... 184/1.5; 123/196

[56] References Cited

UNITED STATES PATENTS

| | | | |
|---|---|---|---|
| 1,621,155 | 3/1927 | Davenport | 184/1.5 |
| 3,335,817 | 8/1967 | Horning | 184/1.5 |
| 3,447,636 | 6/1969 | Bonfilio | 184/1.5 |
| 3,720,287 | 3/1973 | Martel | 184/1.5 |
| 3,743,053 | 7/1973 | Kuklewicz | 184/1.5 |
| 3,908,797 | 9/1975 | Schnepp | 184/1.5 |

*Primary Examiner*—Richard C. Pinkham
*Assistant Examiner*—Marvin Siskind
*Attorney, Agent, or Firm*—Fishburn, Gold & Litman

[57] ABSTRACT

This device consists primarily of an electric vacuum pump which includes a discharge line and an input line secured to a three-way valve having handle for selection. A line attached to the valve of the device is secured to a fitting threadably secured within the oil pan of the engine and another line secured to the valve is secured by a fitting to the oil filter, the valve serving to completely eliminate the oil and dirt from the oil pan while also removing the oil from the filter.

2 Claims, 4 Drawing Figures

AUTOMOBILE ELECTRIC VACUUM PUMP FILTERING SYSTEM

This invention relates to engine lubricating systems, and more particularly to an automobile electric vacuum pump filtering system.

It is therefore the principal object of this invention to provide an automobile electric vacuum pump filtering system which will remove the oil and dirt from the crank case of the engine while simultaneously through valve means, will remove the old oil from the filter.

Another object of the invention is to provide an automobile electric vacuum pump filtering system which will enable the user to reduce the normal expenses required for changing filters, the device making it unnecessary to the change the oil filter any more than twice during the life time of the vehicle.

Another object of this invention is to provide a system of the type described which will enable the owner to change the oil more often with a great deal less expense, thus prolonging the life of the engine while enabling the engine to deliver better performance.

A further object of this invention is to provide a system of the type described, which will have vacuum pump means that will remove all of the old oil as well as the dirt, thus leaving the crank case completely clean and the three-way selector valve of the system, enables the pump to remove the oil from both the filter and the crank case in a matter of a few minutes.

A still further object of this invention is to provide a system of the type described, which will include a discharge line attached to the pump and an input line secured to the three-way selector valve, the valve being connected also to a line secured by fitting means to the oil pan of the engine while a second line to the valve is connected to the fitting of an oil filter, enabling both the filter and the crank case to be drained and the device is of such structure, so as to be operated by anyone, the oil being removed from the engine, without having the vehicle leaving the garage, driveway or sidewalk.

An even further object of this invention is to provide a system of the type described, which in use, will eliminate the dirt from the oil pan that a regular oil change cannot effect while the system will eliminate the time and expenses spent at a service station.

Other objects of the present invention are to provide an automobile electric vacuum pump filtering system which is simple in design, inexpensive to manufacture, rugged in construction, easy to use and efficient in operation.

These and other objects will be readily evident upon a study of the following specification and the accompanying drawing, wherein.

Figure 1:
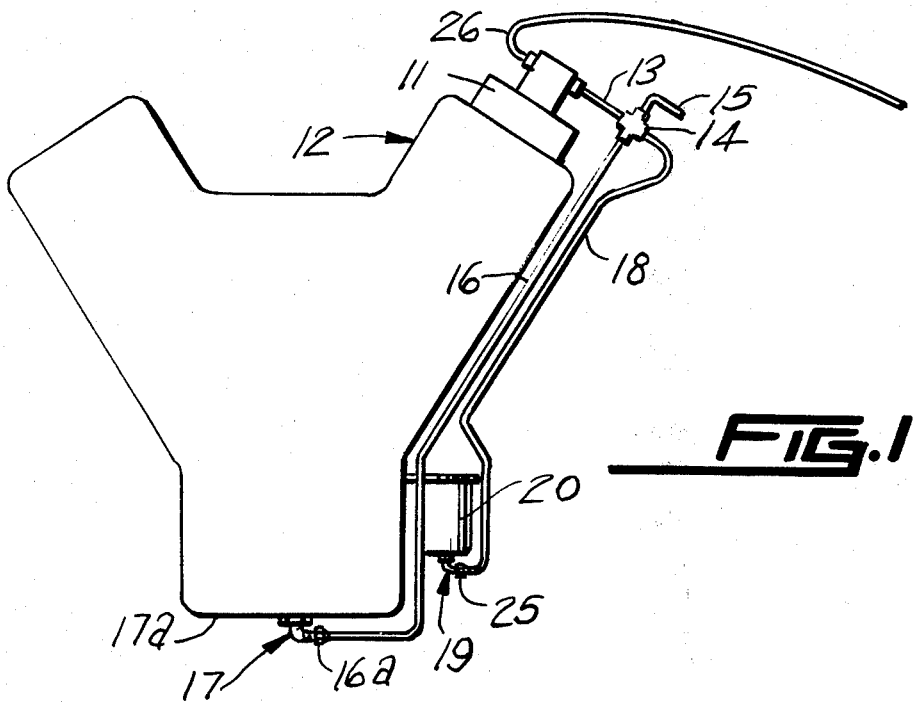
FIG. 1 is a diagrammatic end view of an internal combustion engine showing the present invention installed thereon.
Figure 2:
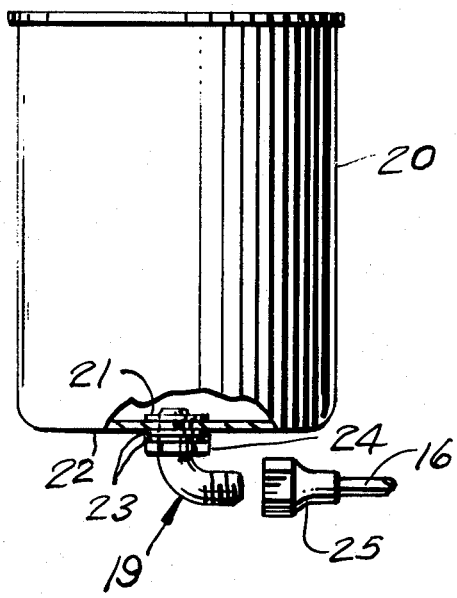
FIG. 2 is an enlarged side view of the filter of FIG. 1, shown in elevation with the lower portion shown partly broken away.

According to this invention, system 10 is shown to include an electric vacuum pump 11 secured in a suitable manner to engine 12. An input line 13 is secured to one side of pump 11 and is secured at its opposite end in a well known manner, to a three-way selector valve 14 having a manually operated handle 15. A line 16 is secured to at one end to three-way valve 14 and is secured at its opposite end by fittings 16*a*, to a swivel fitting 17 which is carried within oil pan 17*a*, a second line 18 is secured to valve 14 at one end and is secured by fitting 25 to fitting 19 of oil filter 20. Fitting 19 is provided with a flange 21 carried on the interior of filter 20, the flange 21 abutting with the wall 22 of filter 20. Abutting with the opposite side of wall 22 and carried on fitting 19, are a pair of oil seals 23, the fitting being secured to filter 20 by means of nut fastener 24.

The swivel fitting 17 carried within oil pan 17*a*, is provided with an arcuately curved tube 17*b* so as to enable the pump 11 to pull the dirty oil from oil pan 17*a*.

When it is desired to change the oil of the oil pan 17*a* and the oil filter 20, the user grasp the handle 15 and rotates it to the desired position for removing the oil from the oil pan 17*a*, the pump 11 when turned on, will cause by vacuum means, the oil of oil pan 17*a* to be carried upwards within line 16, through valve 14, through pump 11, and out of the discharge line 26 attached to pump 11. The handle 15 is then rotated to the position for draining the oil filter 20. The oil within filter 20 is carried upwards through line 18 through valve 14, through line 13, through pump 11 and out of the discharge line 26 into a suitable container.

Figure 3:
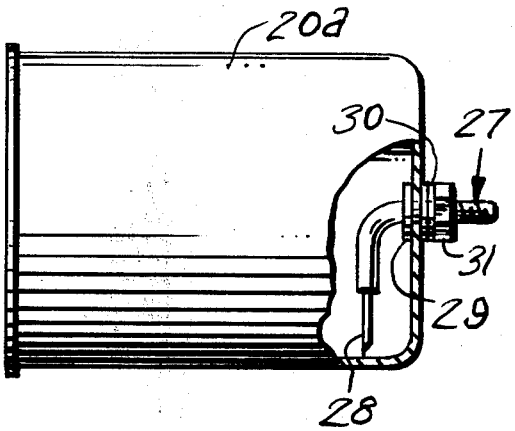
FIG. 3 is a side view of a side mounted filter, shown in elevation and partly broken away.
Figure 4:
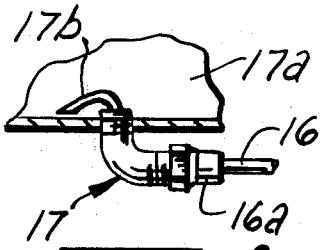
FIG. 4 is a fragmentary side view of an oil pan showing the outlet tube and fitting.

Referring now more particularly to FIG. 3 of the drawing, a side mounted filter 20*a* is provided with a fitting 27 having a tube 28 for oil pick up on the interior of filter 20*a*. Fitting 27 is also provided with a flange 29, a pair of oil seals 30, and a nut fastener 31 which secures it to filter 20*a*, by using this type of fitting 27 it will permit fitting connections after the filter 20*a* is been tightened into any position. After the filter 20*a* has been tightened, the fitting 27 will be rotated to the correct position with the tube 28 down as shown, by a mark upon the fitting, (Not shown), then the line 18 is connected thereto.

While various change may be made in the detail construction, it is understood that such changes will be within the spirit and scope of the present invention as is defined by the appended claims.

What I now claim is:

1. In combination, an oil drainage system and an internal combustion engine having an oil pan and an external oil filter including a wall, said pan and filter normally containing lubricating oil, said combination comprising: a vacuum pump mounted on said engine and having an input and an output, a three-way valve arrangement having an exit and alternate inputs, said valve exit being connected to said pump input, a first fitting communicating into said oil pan, a first line connected between said oil pan fitting and one of said valve arrangement inputs, a second fitting communicating into said filter through said filter wall, a second line connected between said second fitting and the other of said valve arrangement inputs, a discharge line connected to said pump output, and means alternately selecting one of said alternate inputs in said valve arrangement for communicating with said exit whereby oil is removable from said oil pan and said filter through said discharge line.

2. The combination as set forth in claim 1 including: a curved tube connected to at least one of said fittings and having a free end extending downwardly for oil removal.

* * * * *